US010348023B2

(12) United States Patent
Hirota

(10) Patent No.: US 10,348,023 B2
(45) Date of Patent: Jul. 9, 2019

(54) CONNECTOR WITH RETAINER

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 16 days.

(21) Appl. No.: 15/884,497

(22) Filed: Jan. 31, 2018

(65) Prior Publication Data

US 2018/0248294 A1 Aug. 30, 2018

(51) Int. Cl.

| | |
|---|---|
| ***H01R 24/28*** | (2011.01) |
| ***H01R 13/436*** | (2006.01) |
| ***H01R 13/424*** | (2006.01) |
| ***H01R 13/422*** | (2006.01) |

(52) U.S. Cl.

CPC ..... *H01R 13/4365* (2013.01); *H01R 13/424* (2013.01); *H01R 13/4223* (2013.01)

(58) Field of Classification Search

CPC ..... H01R 13/4365

See application file for complete search history.

(56) References Cited

U.S. PATENT DOCUMENTS

| | | | | |
|---|---|---|---|---|
| 7,828,581 | B2 * | 11/2010 | Okayasu | H01R 43/20 439/352 |
| 8,678,866 | B2 * | 3/2014 | Hiraishi | H01R 13/4365 439/595 |
| 8,708,739 | B2 * | 4/2014 | Takeda | H01R 13/4365 439/595 |
| 8,795,000 | B2 * | 8/2014 | Sugimoto | H01R 13/4364 439/595 |
| 9,306,311 | B2 * | 4/2016 | Kitajima | H01R 13/4362 |
| 2004/0106330 | A1 * | 6/2004 | Mase | H01R 13/506 439/695 |
| 2008/0009201 | A1 * | 1/2008 | Hiramatsu | H01R 13/4365 439/752 |
| 2012/0309219 | A1 * | 12/2012 | Hiraishi | H01R 13/4223 439/352 |
| 2013/0012042 | A1 * | 1/2013 | Takeda | H01R 13/4223 439/137 |

FOREIGN PATENT DOCUMENTS

| | | |
|---|---|---|
| JP | 2016-122573 | 7/2016 |

* cited by examiner

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A connector includes a housing (20) and a front retainer (40) to be mounted into the housing (20) from the front. The housing (20) includes locking lances (31) for locking terminal fittings (10) inserted to proper positions. The locking lance (31) is pressed by the terminal fitting (10) and retracted into a deflection space (S1) when the terminal fitting (10) is inserted, and resiliently returns and locks the terminal fitting (10) when the terminal fitting (10) is inserted properly. The front retainer (40) includes deflection restricting portions (42) for restricting deformation of the locking lances (31) by entering the deflection spaces (S1), and includes ribs (45) that can contact and guide a tip of a tab (11) if the tab (11) is inclined during insertion of the terminal fitting (10).

2 Claims, 12 Drawing Sheets

CONNECTOR WITH RETAINER

BACKGROUND

Field of the Invention

The invention relates to a connector with retainer.

Description of the Related Art

Japanese Unexamined Patent Publication No. 2016-122573 discloses a connector with a housing, and a male terminal fitting with a tab is inserted into the housing from behind. A locking lance is provided in the housing and is capable of locking the properly inserted terminal fitting. The terminal fitting presses the locking lance during the insertion into the housing and causes the locking to retract into a deflection space. However, the locking lance resiliently returns and locks the properly inserted terminal fitting. A front retainer is mounted into the housing from the front. The front retainer includes a displacement limiting portion that enters the deflection space for the locking lance to limit the retraction of the locking lance. The front retainer is mounted at a partial locking position where the displacement limiting portion is forward of the deflection space when the terminal fitting is inserted and at a full locking position where the displacement limiting portion is in the deflection space after the terminal fitting is inserted properly. In this way, the retraction of the locking lance from the terminal fitting is limited to reliably retain the terminal fitting.

The above-described connector requires a large space in front of the locking lance at the partial locking position where the front retainer is retracted forwardly. Thus, a tab of the terminal fitting that is inclined may enter the space in front of the locking lance and may butt against the front retainer to be broken.

The invention was completed on the basis of the above situation and aims to provide a connector with retainer that prevents deformation of a tab during insertion of a terminal fitting.

SUMMARY

The invention is directed to a connector with a housing, and a terminal fitting including a tab is inserted into the housing from behind. The housing includes a locking lance that is capable of locking the terminal fitting that has been inserted to a proper position. The terminal fitting presses the locking lance during the insertion into the housing and causes the locking to retract into a deflection space. However, the locking lance resiliently returns and locks the properly inserted terminal fitting. A front retainer is mounted into the housing from the front and includes a deflection restricting portion. The retainer is mountable at a partial locking position where the deflection restricting portion is forward of the deflection space and at a full locking position where the deflection restricting portion is in the deflection space for restricting deformation of the locking lance. The retainer includes a rib, and a tip part of the tab contacts the rib if the tab is inclined during the insertion of the terminal fitting at the partial locking position. Accordingly, the tab will not incline to enter a space in front of the locking lance when the terminal fitting is inserted. Thus, the tab will not break.

A front wall of the housing may have a tab insertion hole, and the tab is inserted into the tab insertion hole. The rib may have a guide surface for guiding the tab toward the tab insertion hole. Accordingly, an inserting operation of the terminal fitting can be easily performed.

DETAILED DESCRIPTION

An embodiment of the invention is described in detail with reference to FIGS. 1 to 12.

Figure 2:
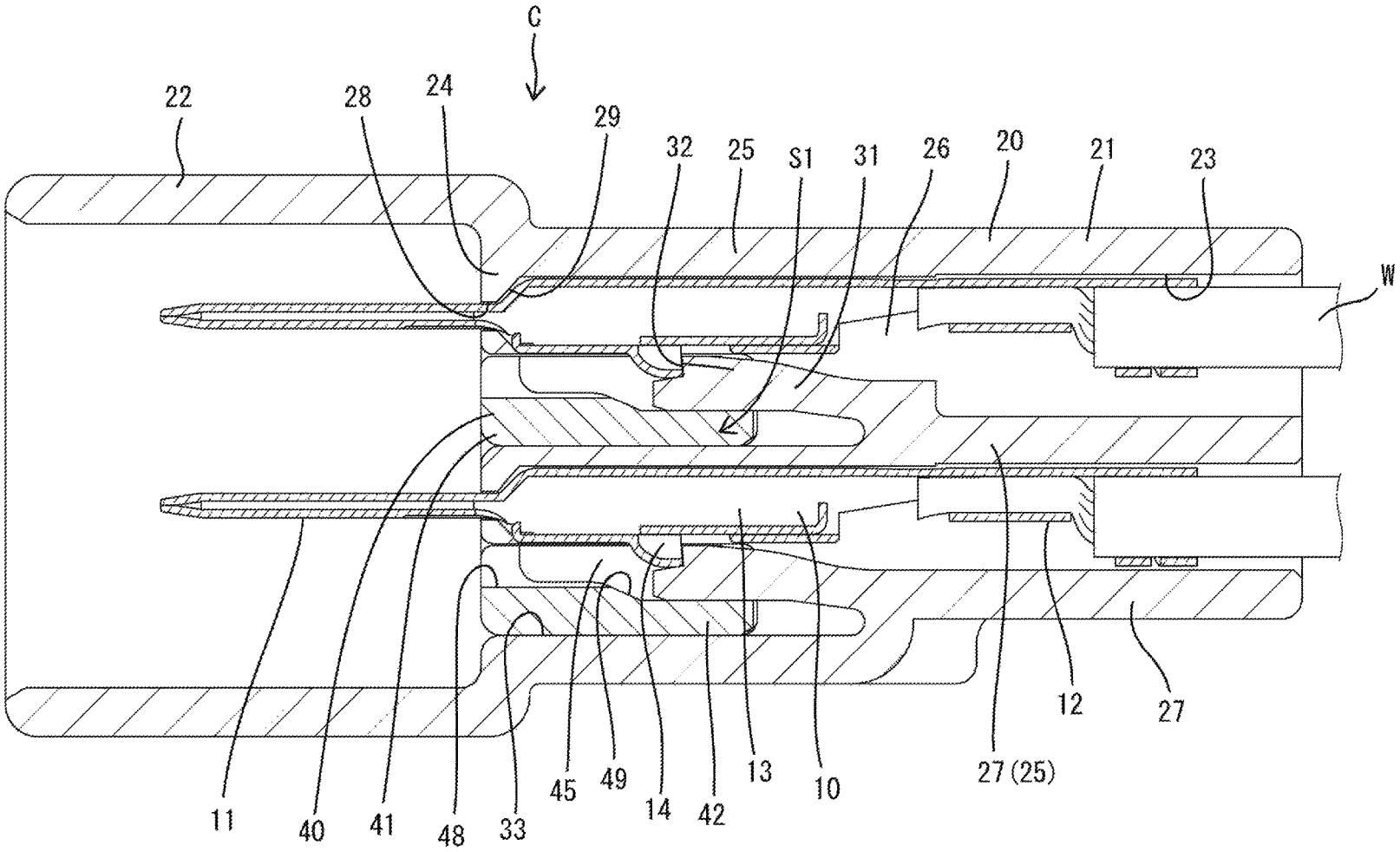
FIG. 2 is a section, corresponding to a cross-section at position A-A of FIG. 1, showing the connector in the state where the terminal fittings are properly inserted.

A connector in this embodiment is identified by the letter C and includes a housing 20. Male terminal fittings 10 are inserted the housing 20 from behind, and each male terminal fitting 10 includes a tab 11 on a front end. A front retainer 40 is mounted into the housing 20 from the front. In the following description, in each constituent member, a connection end to an unillustrated mating connector (left side of FIG. 2) is referred to as a front and an opposite end (right side of FIG. 2) is referred to as a rear. Upper and lower sides of FIG. 2 are referred to as upper and lower sides.

Figure 1:
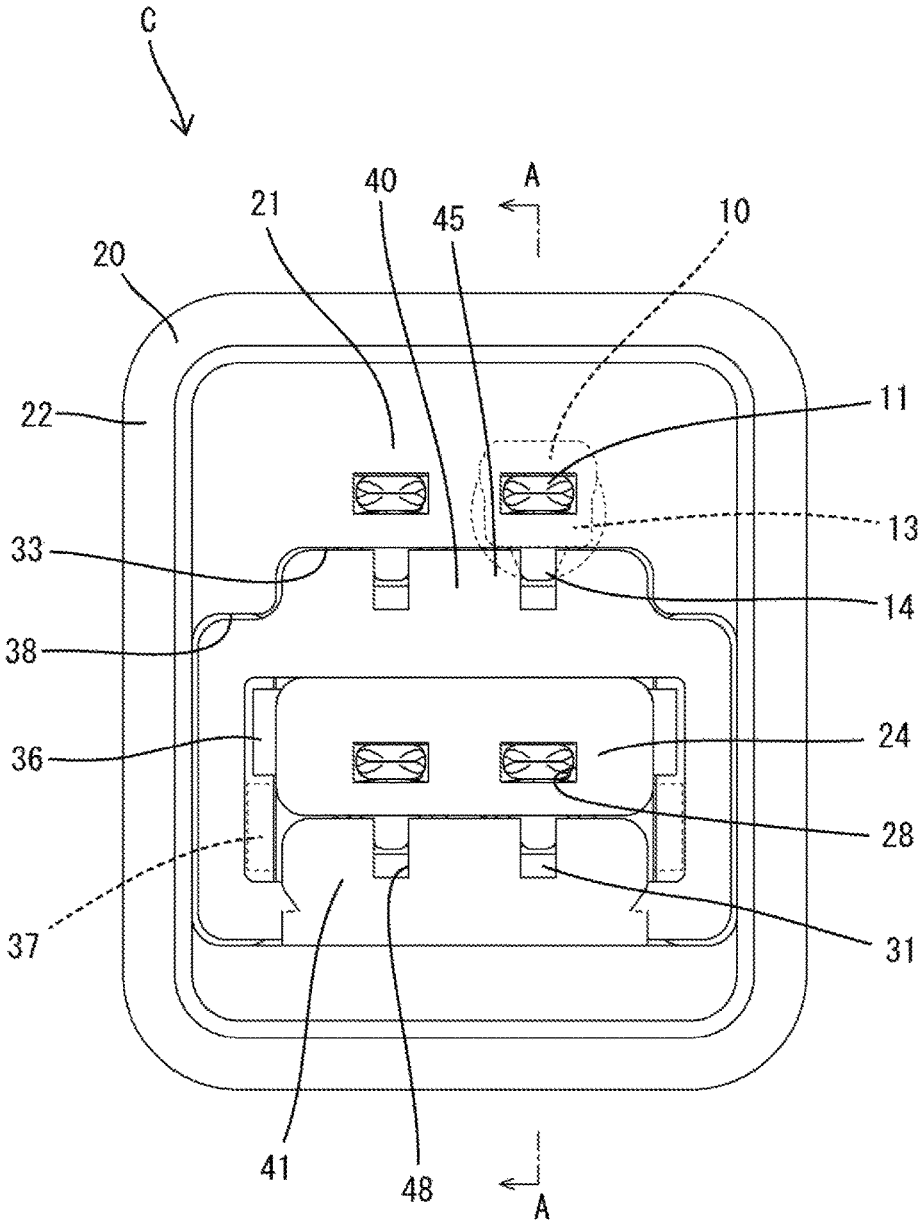
FIG. 1 is a front view of a connector in an embodiment showing a state where terminal fittings are properly inserted.
Figure 3:
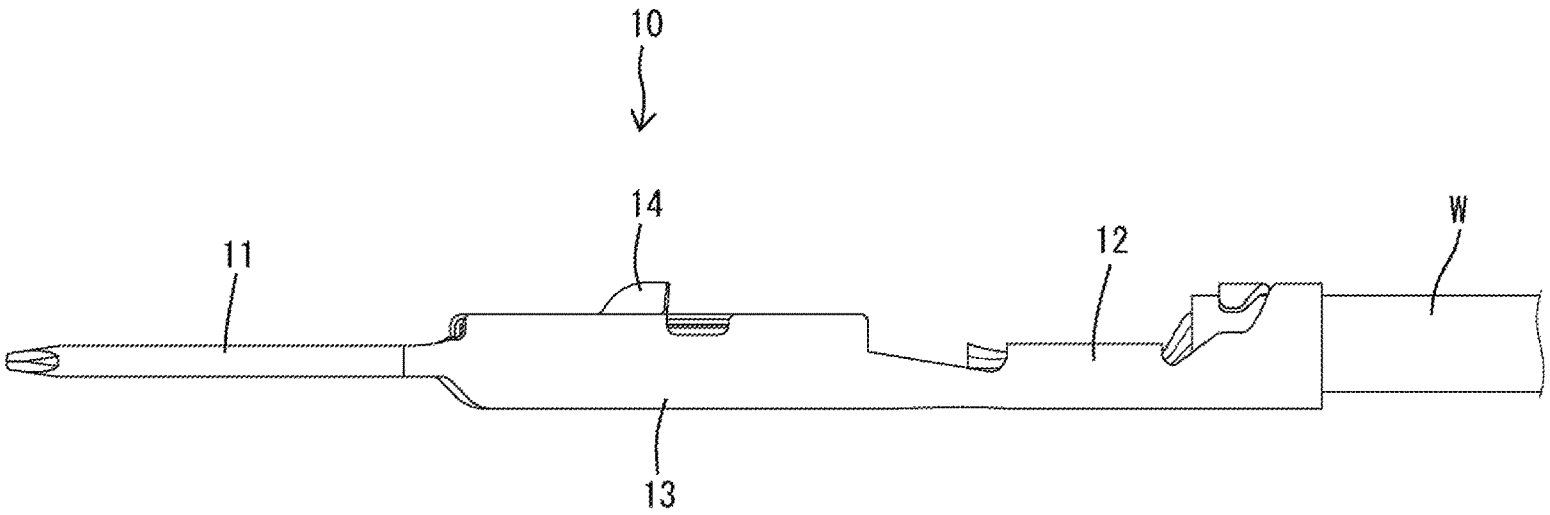
FIG. 3 is a side view of the terminal fitting.
Figure 4:
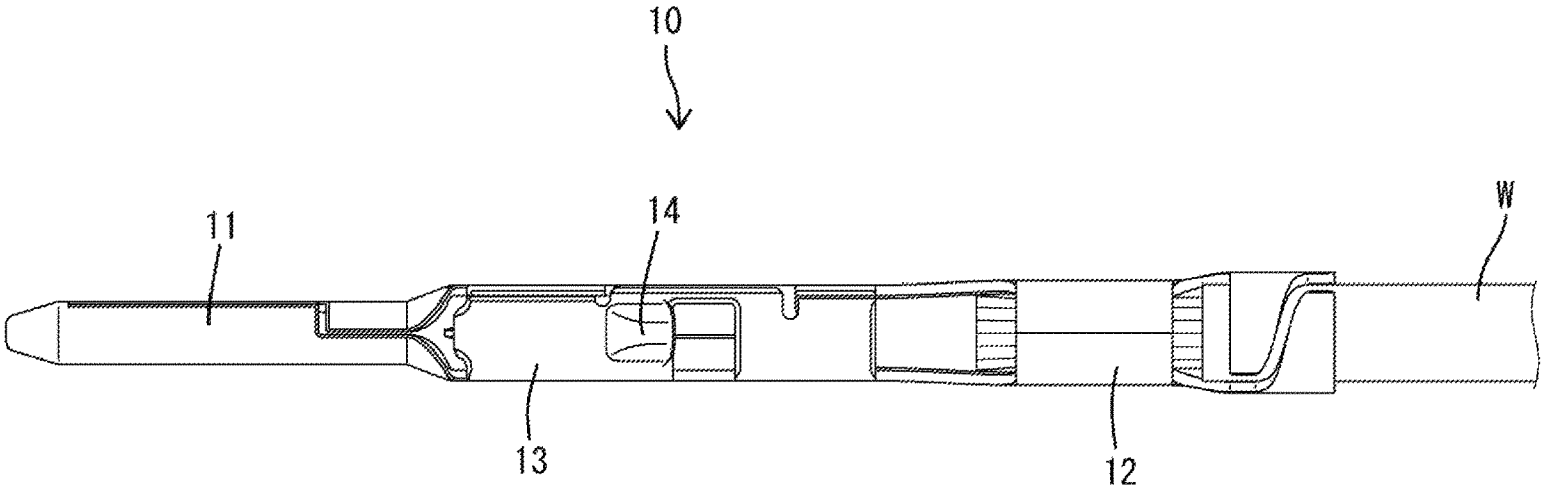
FIG. 4 is a bottom view of the terminal fitting.

As shown in FIGS. 3 and 4, the terminal fitting 10 is long and narrow, and has a tab 11 at a front end and a wire connecting portion 12 at a rear end for connection to an end part of a wire W. The tab 11 projects forward from the front end of a body 13 and contacts an unillustrated female terminal fitting to be electrically connected. As shown in FIG. 1, the tab 11 is a substantially flat plate formed by folding a metal plate material so that a dimension in an overlapping direction of the metal plate material is smaller than a dimension in a direction intersecting the overlapping direction. The tip of the tab 11 is tapered.

The terminal body 13 has a lock receiving portion 14 lockable by a locking lance 31 of the housing 20 to be described later. The lock receiving portion 14 is provided at an intermediate position of the terminal body 13 in a front-rear direction, and projects out from an outer surface of the terminal body 13. The lock receiving portion 14 is located substantially at a center of the terminal body 13 in a width direction.

The housing 20 is made of synthetic resin and includes a terminal accommodating portion 21 in which the terminal fittings 10 are accommodated, and a receptacle 22 that can fit to a mating housing.

The terminal accommodating portion 21 has cavities 23 into which the terminal fittings 10 are accommodated individually. The cavities 23 are provided in plural stages (two in this embodiment) in a vertical direction, and plural cavities 23 (two in this embodiment) are arranged in each stage. Each cavity 23 has a front wall 24, a ceiling wall 25, left and right side walls 26 and a bottom wall 27 of each cavity 23. The ceiling wall 25 and the side walls 26 extend over the entire length of each cavity 23.

The front wall 24 is provided tab insertion holes 28 through which the tabs 11 are inserted. Each tab insertion hole 28 penetrates through the front wall 24 in the front-rear direction and has a wide rectangular shape that is closed over the entire periphery. A guiding surface 29 is formed on the rear surface of the front wall 24 and is configured to guide the tab 11 into the tab insertion hole 28. The guiding surface 29 is provided around upper, lower, left and right sides of the tab insertion hole 28 and is inclined to narrow the cavity 23 gradually toward the tab insertion hole 28.

The bottom wall 27 is provided in a substantially rear half of each cavity 23, and the locking lance 31 that locks the terminal fitting 10 in a proper position is provided in front of the bottom wall 27. The locking lance 31 has a base end coupled to the bottom wall 27 and is cantilevered forward. The locking lance 31 is resiliently deflectable in the vertical direction. The locking lance 31 is narrower than the tab 11.

A locking surface 32 is provided on the upper surface of the locking lance 31 (see FIG. 2) and is lockable to the lock receiving portion 14 from behind. The locking surface 32 is substantially perpendicular to an inserting/withdrawing direction of the terminal fitting 10. Note that a front end part of the locking lance 31 projects slightly farther forward than the locking surface 32.

A deflection space S1 is provided below the locking lance 31 for allowing resilient deflection of the locking lance 31. The locking lance 31 is pressed by the terminal fitting 10 and retracts into the deflection space S1 when the terminal fitting 10 is inserted. The locking lance 31 then resiliently returns and locks the terminal fitting 10 when the terminal fitting 10 is inserted properly. The deflection space S1 is open forward.

The terminal accommodating portion 21 is provided with a retainer accommodating portion 33 into which the front retainer 40 is accommodated. The retainer accommodating portion 33 is a space provided in a front end part of the terminal accommodating portion 21 and opens forward around the locking lances 31. The retainer accommodating portion 33 includes insertion spaces S2 into which ribs 45 of the front retainer 40 to be described later are inserted from the front (see FIG. 11). The insertion spaces S2 are provided laterally to the locking lances 31. Each insertion space S2 is open forward while having a height equivalent to a height of the locking lance 31 and communicates with the deflection space S1 in the lateral direction.

Figure 9:
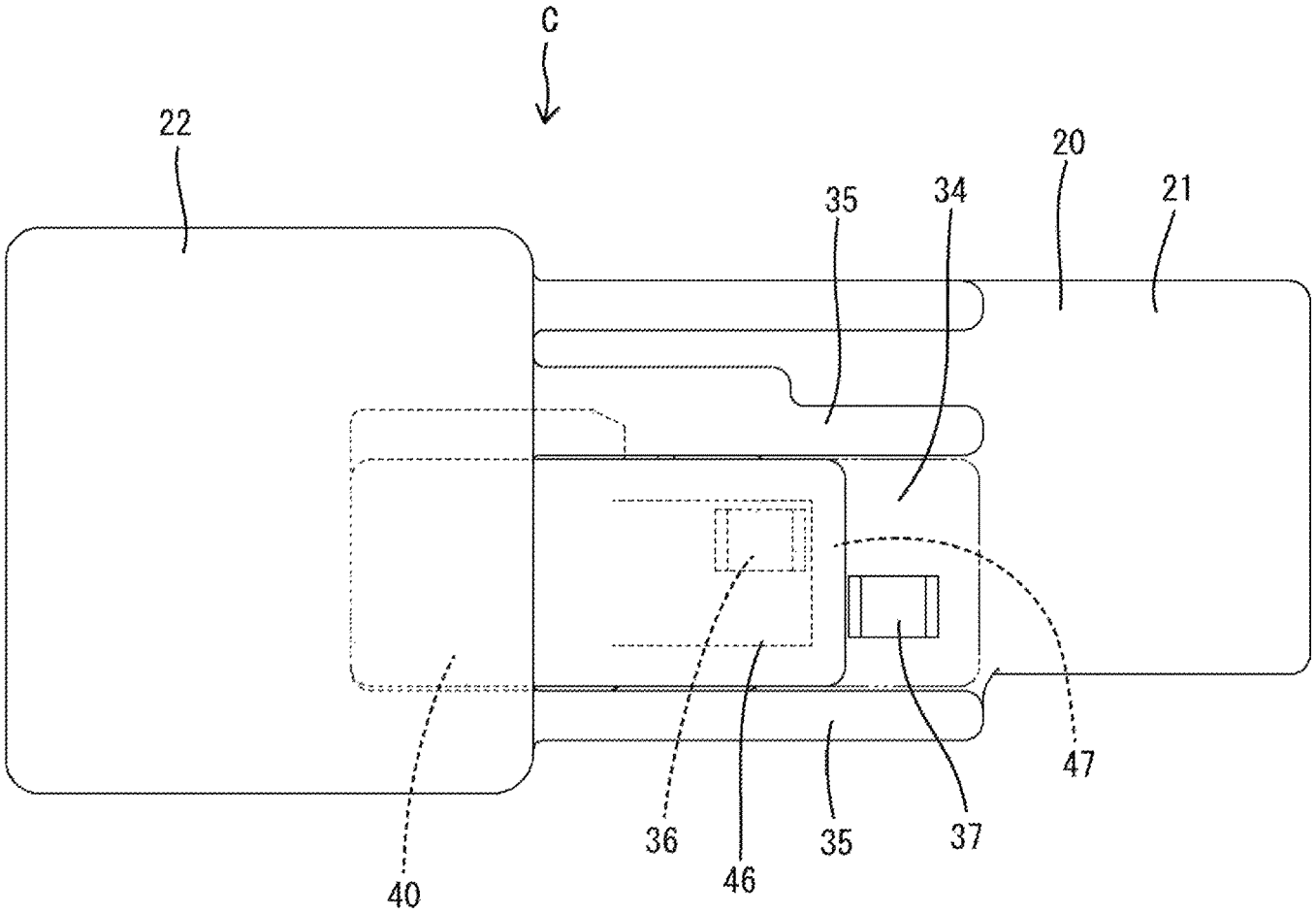
FIG. 9 is a side view showing the connector in a state where the front retainer is mounted at a partial locking position.
Figure 10:
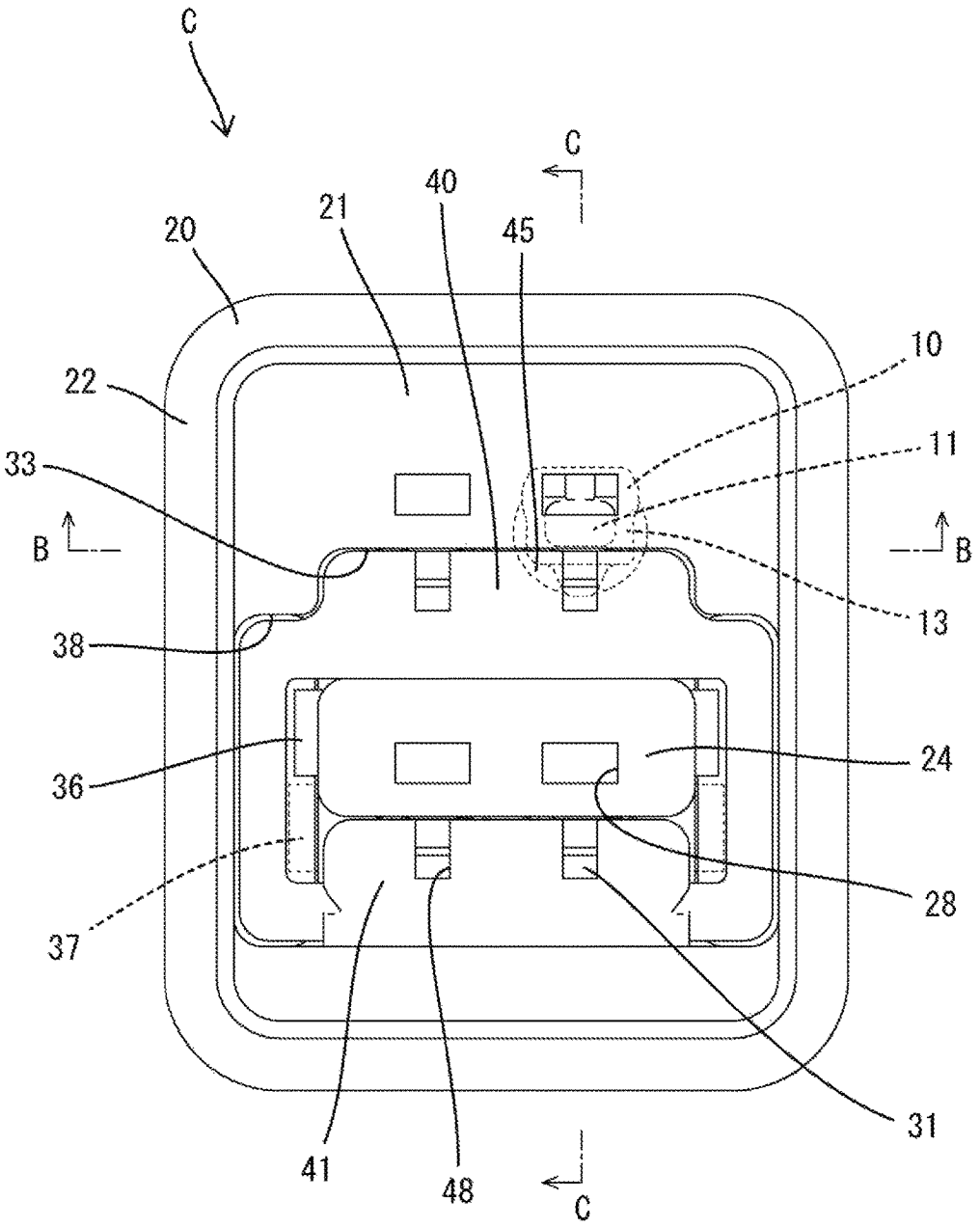
FIG. 10 is a front view of the connector showing a state where a tab portion comes into contact with ribs during the insertion of the terminal fitting.

The housing 20 is provided with fitting receiving portions 34 that can receive fitting portions 46 of the front retainer 40 (see FIG. 9). The fitting receiving portions 34 are provided in both side surfaces of the terminal accommodating portion 21. Ridges 35 are provided above and below the fitting receiving portions 34 and extend in the front-rear direction.

The fitting receiving portion 34 has a partial locking projection 36 lockable when the front retainer 40 is at a partial locking position and a full locking projection 37 lockable when the front retainer 40 is at a full locking position. The partial locking projection 36 and the full locking projection 37 project on each side surface of the terminal accommodating portion 21. The partial locking projection 36 is forward of and higher than the full locking projection 37. A projecting dimension of the partial locking projection 36 is smaller than that of the full locking projection 37 (see FIG. 1).

The receptacle 22 has a tubular shape and projects forward from the terminal accommodating portion 21. The receptacle 22 is expanded slightly more outward than the terminal accommodating portion 21. A back wall of the receptacle 22 is provided with passages 38 for allowing the fittings 46 of the front retainer 40 to pass to the fitting receiving portions 34 (see FIG. 11). Each passage 38 is a hole having a vertically long rectangular shape and penetrates through the back wall of the receptacle 22 in the front-rear direction.

The front retainer 40 includes deflection restricting portions 42 for restricting deflection and deformation of the locking lances 31 by entering the deflection spaces S1. The front retainer 40 is mountable at the partial locking position (see FIG. 12) where the deflection restricting portions 42 are forward of the deflection spaces S1 and at the full locking position (see FIG. 2) where the deflection restricting portions 42 are in the deflection spaces S1.

Figure 5:
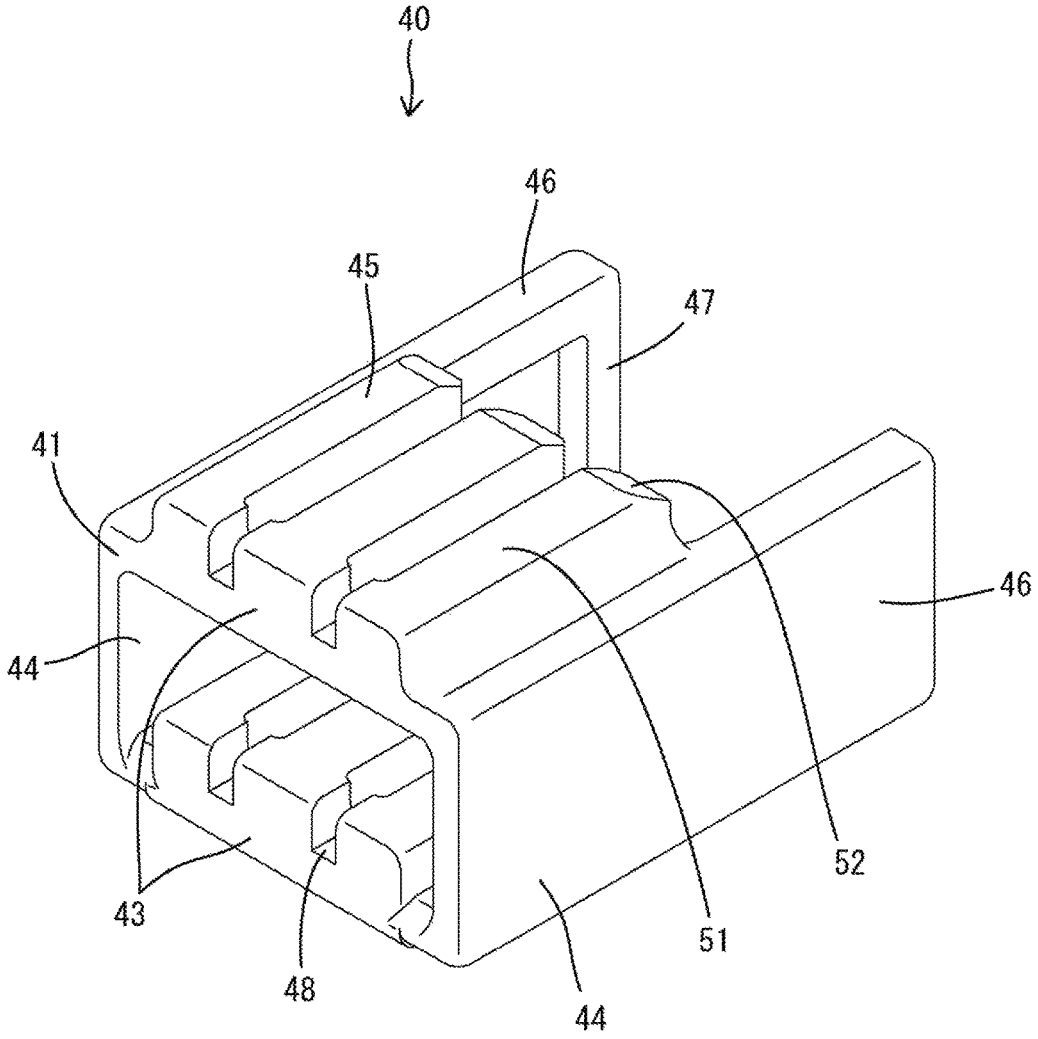
FIG. 5 is a perspective view showing a front retainer.
Figure 6:
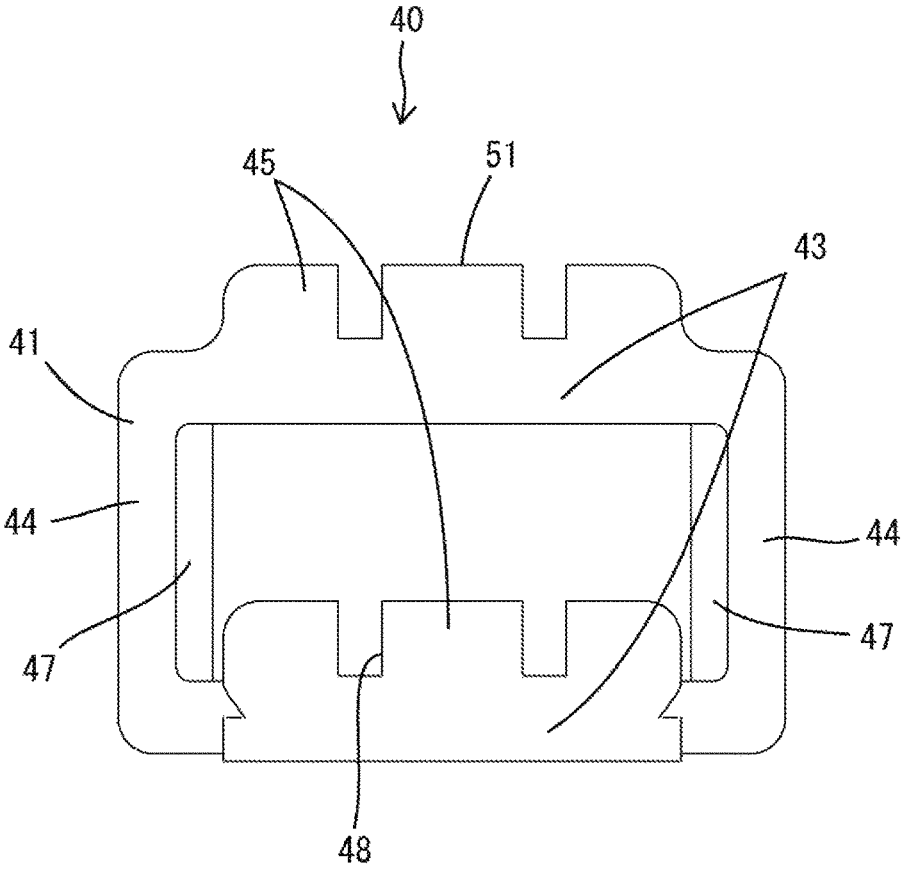
FIG. 6 is a front view showing the front retainer.
Figure 8:
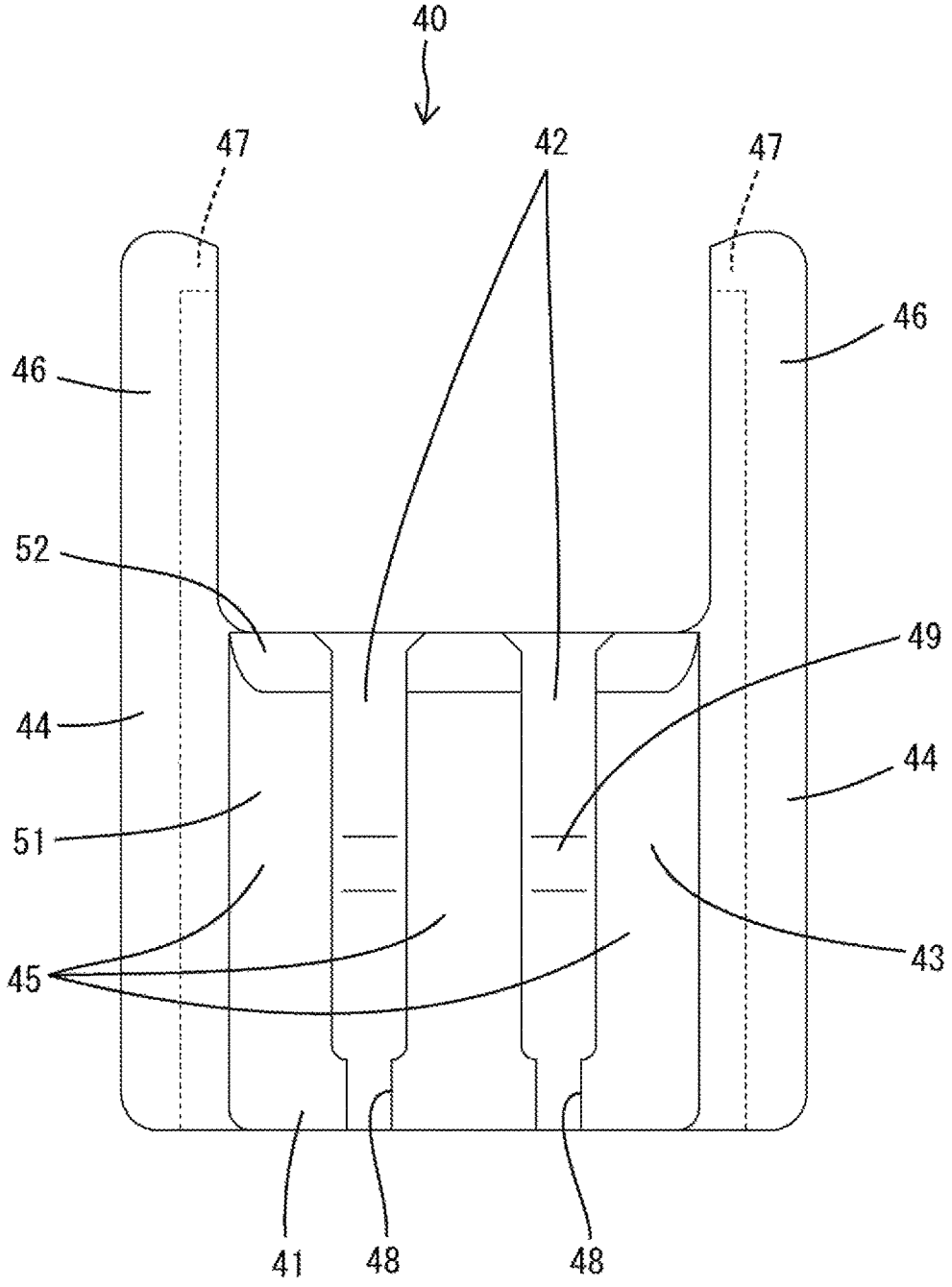
FIG. 8 is a plan view showing the front retainer.

The deflection restricting portions 42 are provided in a retainer body 41 of the front retainer 40 (see FIG. 8). As shown in FIG. 5, the retainer body 41 includes body constituting portions 43 that correspond to the number of stages of the cavities 23 and coupling walls 44 that couple the body constituting portions 43 in the vertical direction. The coupling walls 44 are provided on both left and right end parts of the body constituting portions 43, and the retainer body 41 is a rectangular tube open on both front and rear ends.

The deflection restricting portions 42 correspond to the respective locking lances 31 and two deflection restricting portions 42 are provided side by side in the lateral direction in each body constituting portion 43. The deflection restricting portion 42 has a thickness equal to a height of the deflection space S1 in a natural state where the locking lance 31 is not deflected and a width equal to the width of the locking lance 31. The ribs 45 are provided at both sides of the deflection restricting portion 42, and a tip of the tab 11 can contact the rib 45 if the tab 11 is inclined during the insertion of the terminal fitting 10. The ribs 45 are described in detail later.

As shown in FIG. 5, the coupling walls 44 having fittings 46 that project more rearward than the body constituting portions 43. Each fitting 46 is a wall and two of the fittings 46 face each other on both left and right sides of the front retainer 40. Each fitting 46 has a lock 47 that is lockable to the partial locking projection 36 when the front retainer 40 is at the partial locking position and that is lockable to the full locking projection 37 when the front retainer 40 is at the full locking position. The lock 47 projects along an outer edge of the fitting 46. The lock 47 includes a part extending along the rear edge of the fitting 46 and a part extending along both upper and lower edges.

Figure 12:
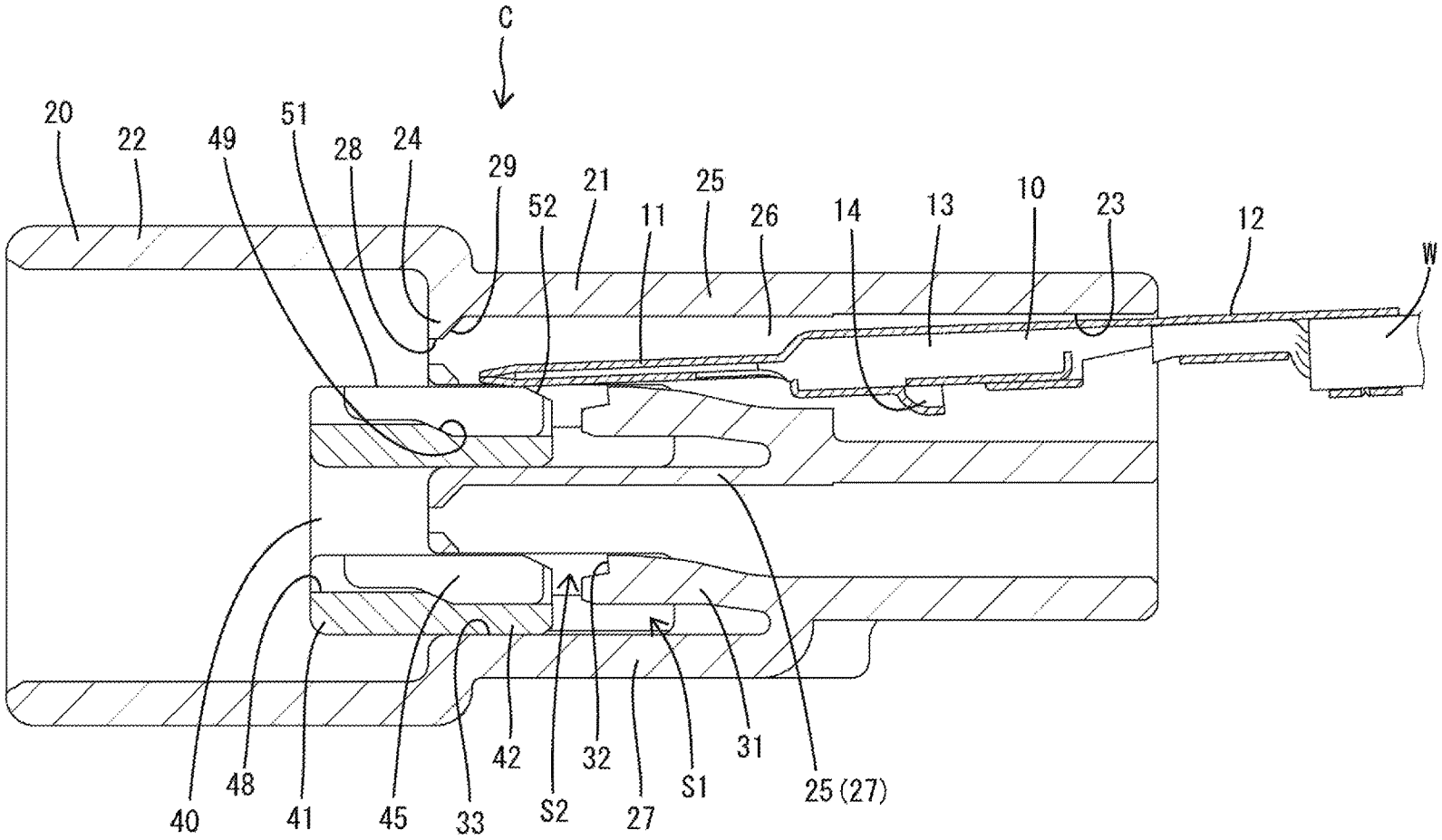
FIG. 12 is a section, corresponding to a cross-section at position C-C of FIG. 10, showing the connector in the state where the tab portion comes into contact with the ribs during the insertion of the terminal fitting.

Jig holes 48 are provided in a front end part of the front retainer 40 and receive an unillustrated jig for retracting the locking lance 31 into the deflection space S1 when the terminal fitting 10 is pulled out for maintenance or the like. The jig hole 48 is a groove open on both front and rear sides and an upper side. The jig holes 48 are located outside the retainer accommodating portion 33 and are entirely open, as shown in FIG. 12, when the front retainer 40 is at the partial locking position, and are located inside the retainer accommodating portion 33 and have the upper sides closed by the front walls 24, as shown in FIG. 2, when the front retainer 40 is at the full locking position.

A stepped surface 49 is formed between the bottom surface of the jig hole 48 and the upper surface of the deflection restricting portion 42. The stepped surface 49 is inclined down from the jig hole 48 toward the deflection restricting portion 42. The stepped surface 49 is substantially in a center of the retainer body 41 in the front-rear direction.

As shown in FIG. 8, the ribs 45 project at both sides of each deflection restricting portion 42. The ribs 45 of the upper body constituting portion 43 project slightly farther up than the coupling walls 44. The ribs 45 extend from the front end to the rear end of the retainer body 41. In other words, the rear ends of the ribs 45 and those of the deflection restricting portions 42 are aligned in the front-rear direction.

Figure 11:
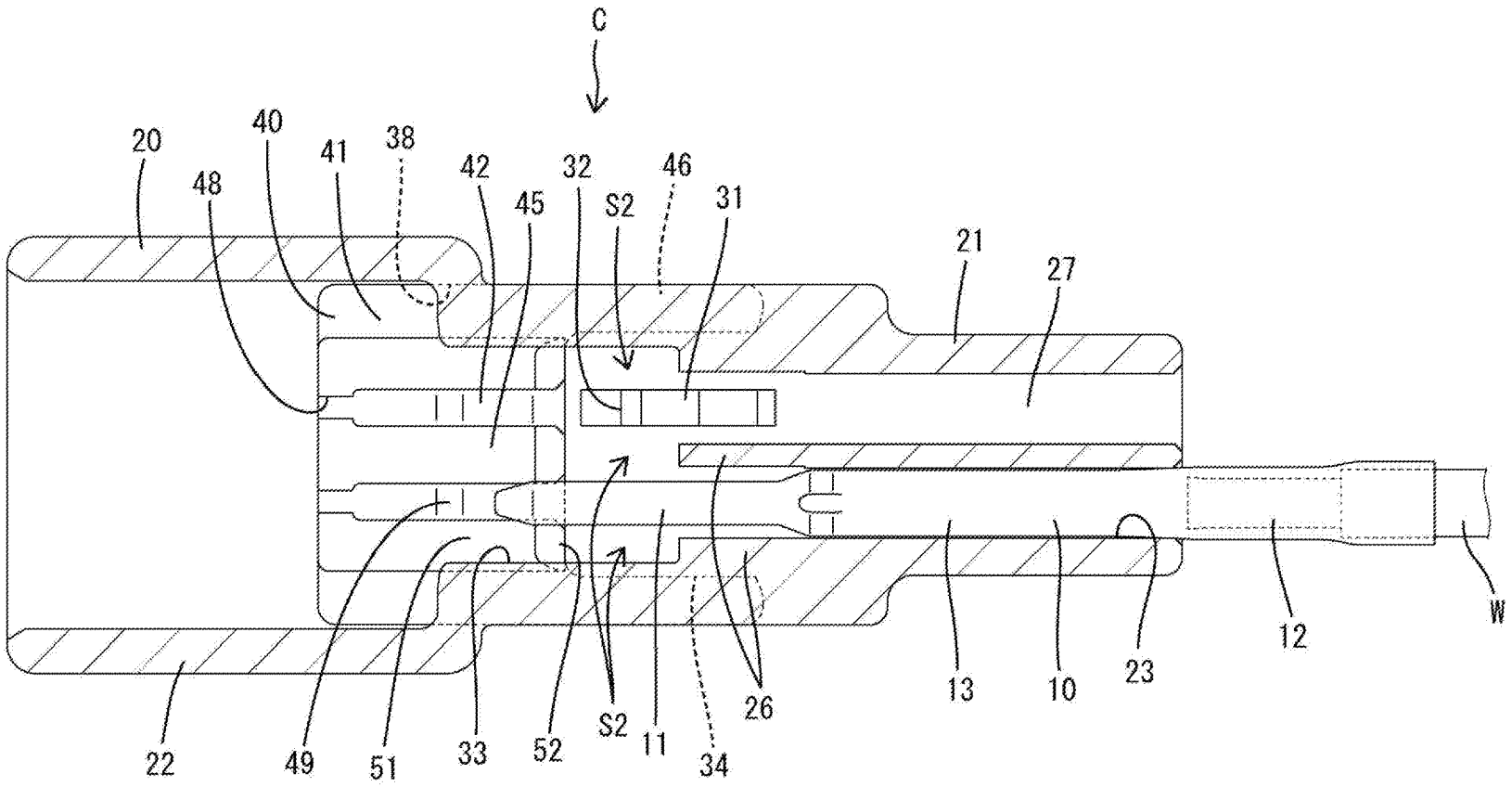
FIG. 11 is a section, corresponding to a cross-section at position B-B of FIG. 10, showing the connector in the state where the tab portion comes into contact with the ribs during the insertion of the terminal fitting.

A height of the rib 45 matches that of the insertion space S2. Further, a width of the rib 45 is set such that the rib 45 projects farther toward a center of the cavity 23 than the side wall 26 corresponding in the front-rear direction as shown in FIG. 11. An interval between the ribs 45 arranged side by side across the deflection restricting portion 42 is smaller than the width of the tab 11. Note that the interval between the ribs 45 is larger than the width of the jig hole 48.

Figure 7:
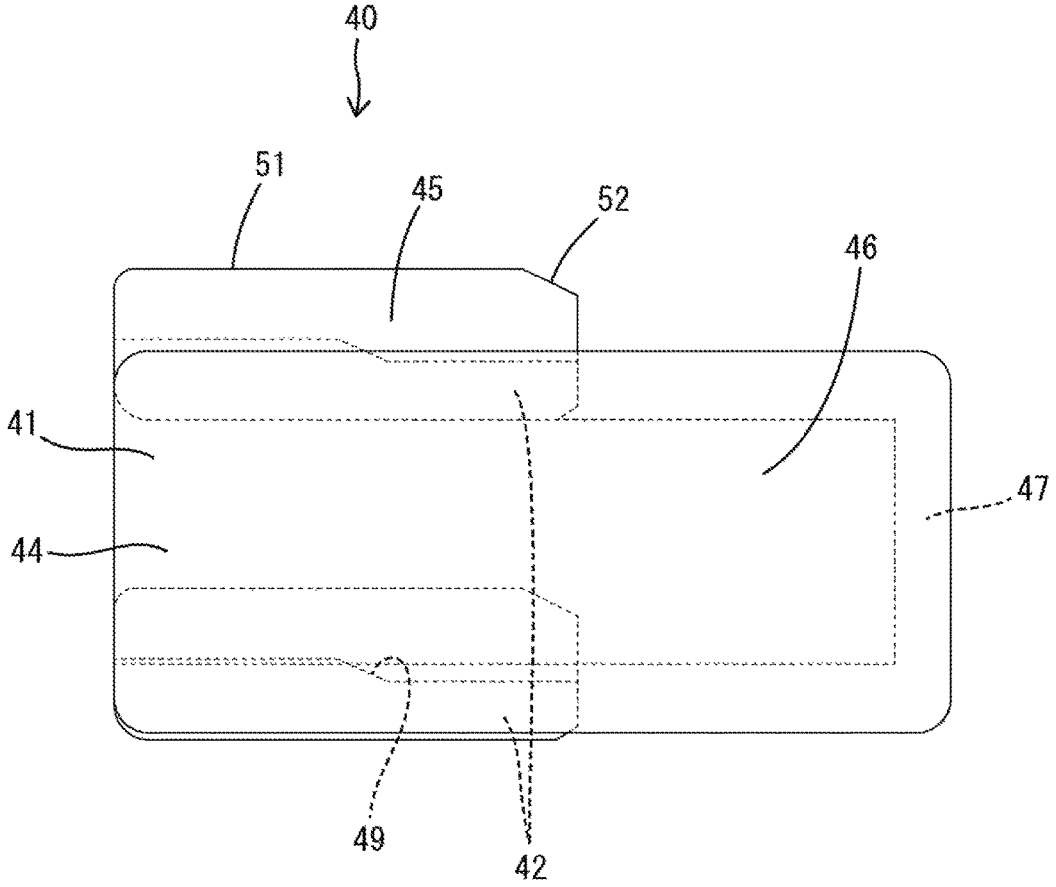
FIG. 7 is a side view showing the front retainer.

An upper projecting end surface 51 of the rib 45 is flat and substantially parallel to an inserting direction of the terminal fitting 10 (see FIG. 7). When the front retainer 40 is mounted into the housing 20, the projecting end surfaces 51 are at the same heights as the lower ends of the guiding surfaces 29. The rib 45 has a guide surface 52 for guiding the tab 11 toward an upper side (toward the tab insertion hole 28). The guide surface 52 is provided on a rear end part of the rib 45 and inclined gradually up toward the front and the front end thereof is connected to the projecting end surface 51.

When the front retainer 40 is at the partial locking position, substantially halves of the ribs 45 are accommodated in the retainer accommodating portion 33 and the entire guide surfaces 52 and halves of the projecting end surfaces 51 face the cavities 23, as shown in FIG. 12. When the front retainer 40 is at the full locking position, the entire ribs 45 are accommodated in the retainer accommodating portion 33 and halves of the ribs 45 are inserted in the insertion spaces S2 at both sides of the locking lances 31, as shown in FIG. 2.

Next, an example of an assembling operation of the connector C of this embodiment is described.

First, the front retainer 40 is mounted at the partial locking position. The front retainer 40 is inserted into the receptacle 22 from the front and the fittings 46 are inserted into the passages 38. The fittings 46 reach the fitting receiving portions 34 and the locking portions 47 move over the partial locking projections 36 and are locked to the partial locking projections 36 (see FIG. 9). The locking portions 47 are fit between the partial locking projections 36 and the full locking projections 37 to restrict a movement of the front retainer 40 in the front-rear direction. At this time, a substantially half of the retainer body 41 projects forward from the retainer accommodating portion 33 and the deflection restricting portions 42 and the ribs 45 are retracted forward of the locking lances 31 (see FIG. 12).

Subsequently, the terminal fittings 10 are inserted into the cavities 23. When the terminal fitting 10 is inserted into the cavity 23 from behind, the tab 11 passes above the locking lance 31 and moves toward the tab insertion hole 28. At this time, the tab 11 may be inclined obliquely before entering the tab insertion hole 28. As shown in FIG. 12, if the tab 11 is inclined obliquely down, the tip part of the tab 11 contacts the guide surfaces 52 or projecting end surfaces 51 of the ribs 45. If the tab 11 contacts the guide surfaces 52, the tab 11 is guided to the projecting end surfaces 51 by the inclination of the guide surfaces 52. After moving along the projecting end surfaces 51, the tab 11 reaches the guiding surface 29 and enters the tab insertion hole 28. In this way, even if the tab 11 is inclined during the insertion of the terminal fitting 10, the tab 11 is inserted into the tab insertion hole 28 without slipping into the space in front of the locking lance 31. Note that if the tab 11 is inclined obliquely up, the tip part of the tab 11 contacts the ceiling wall 25, moves along the ceiling wall 25, reaches the guiding surface 29 and enters the tab insertion hole 28.

When the tab 11 enters the tab insertion hole 28, the terminal fitting 10 is held in a substantially horizontal posture. The lock receiving portion 14 presses the locking lance 31 to retract the locking lance 31 into the deflection space S1 and the terminal fitting 10 moves forward. When the terminal fitting 10 reaches a proper position, the lock receiving portion 14 moves over the locking surface 32 of the locking lance 31, the locking lance 31 resiliently returns and the locking surface 32 is locked to the lock receiving portion 14. In this way, the terminal fitting 10 is retained.

Subsequently, the front retainer 40 is mounted at the full locking position. The front retainer 40 is pushed rearward from the partial locking position after all the terminal fittings 10 are inserted completely to the proper positions. As shown by chain double-dashed line of FIG. 9, the fittings 46 move and the locks 47 move over the full locking projections 37 and are locked to the rear surfaces of the full locking projections 37. In this way, a forward movement of the retainer is restricted.

Further, the entire retainer body 41 is accommodated into the retainer accommodating portion 33 (see FIG. 2). The deflection restricting portions 42 enter the deflection spaces S1 and the ribs 45 enter the insertion spaces S2. The terminal bodies 13 have the lower surfaces supported by the locking lances 31 and the ribs 45 of the front retainer 40.

The deflection restricting portions 42 that have entered the deflection spaces S1 restrict deflection of the locking lances 31 and the terminal fittings 10 are retained reliably.

The ribs 45 that have entered the insertion spaces S2 butt against the side walls 26 to restrict further pushing of the front retainer 40. Further, the adjacent locking lances 31 are partitioned and the spaces lateral to the locking lances 31 are filled by the ribs 45 that have entered the insertion spaces S2. In this way, even if the wire W is pulled strongly, lateral bending deformation of the locking lance 31 can be restricted and the locking lance 31 can maintain a proper shape thereof. Thus, the assembling operation of the connector C is completed.

Next, functions and effects of the embodiment are described.

The connector C of this embodiment includes the housing 20 into which the terminal fittings 10 each including the tab 11 are inserted from behind, and the front retainer 40 which is mounted into the housing 20 from the front. The housing 20 includes the locking lances 31 capable of locking the terminal fittings 10 inserted to the proper positions. The locking lance 31 is pressed by the terminal fitting 10 and retracted into the deflection space S1 when the terminal fitting 10 is inserted, and resiliently returns and locks the terminal fitting 10 when the terminal fitting 10 is inserted properly. The front retainer 40 includes the deflection restricting portions 42 for restricting resilient deformation of the locking lances 31 by entering the deflection spaces S1. The front retainer 40 is mountable at the partial locking position where the deflection restricting portions 42 are forward of the deflection spaces S1 and at the full locking position where the deflection restricting portions 42 are in the deflection spaces S1. The front retainer 40 includes the ribs 45 with which the tip part of the tab 11 can come into contact if the tab 11 is inclined during the insertion of the terminal fitting 10 at the partial locking position. According to this configuration, a tab 11 that is inclined cannot enter the space in front of the locking lance 31 when the terminal fitting 10 is inserted. Therefore, deformation of the tab 11 can be prevented.

Further, the tab insertion holes 28 through which the tabs 11 are inserted are provided in the front walls 24 of the housing 20, and the ribs 45 have the guide surfaces 52 for guiding the tabs 11 toward the tab insertion holes 28. According to this configuration, since the tab 11 is guided toward the tab insertion hole 28 by the guide surface 52, the inserting operation of the terminal fitting 10 can be performed easily.

The invention is not limited to the above described embodiment. For example, the following embodiments are also included in the scope of the invention.

Although the ribs 45 are provided to enter the insertion spaces S2 at both sides of the locking lances 31 in the above embodiment, there is no limitation to this. For example, such as when each locking lance is provided near one side of a cavity, a rib may be provided to enter a space at the other side of each locking lance.

Although the rib 45 has the guide surface 52 in the above embodiment, the guide surface may not necessarily be provided.

LIST OF REFERENCE SIGNS

C . . . connector
S1 . . . deflection space
10 . . . terminal fitting
11 . . . tab
20 . . . housing
24 . . . front wall
28 . . . tab insertion hole
31 . . . locking lance
40 . . . front retainer
42 . . . deflection restricting portion
45 . . . rib
52 . . . guide surface

What is claimed is:

1. A connector, comprising:

a housing with opposite front and rear ends spaced apart along a connecting direction, a cavity formed in the housing and extending in the connecting direction from the rear end to the front end, the cavity having a ceiling wall and a bottom wall opposite the ceiling wall, a resiliently deflectable locking lance cantilevered forward in the cavity, at least one deflection space being defined in the cavity between the locking lance and the bottom wall, and retainer insertion spaces being defined in the cavity laterally adjacent to the locking lance;

a terminal fitting including a tab inserted into the cavity of the housing from behind and along the connecting direction, the terminal fitting deflecting the locking lance into the deflection space during insertion and being held in a locked state by the locking lance that resiliently returns when the terminal fitting is inserted; and a retainer mounted into the housing in the connecting direction from the front and movable between a partial locking position and a full locking position, the retainer including a deflection restriction portion and ribs that are forward of the deflection space and forward of the retainer insertion spaces when the retainer is in the partial locking position, the deflection restricting portion being in the deflection space and the ribs being in the retainer insertion spaces when the retainer is in the full locking position, wherein the deflection restricting portion restricts deflection of the locking lance when the retainer is in the full locking position, and wherein the ribs align the tab along the connecting direction when the retainer is in the partial locking position.

2. The connector of claim 1, wherein:

the housing is provided with a front wall with a tab insertion hole, the tab being inserted into the tab insertion hole; and each of the ribs has a guide surface configured for guiding the tab toward the tab insertion hole when the front retainer (40) is at the partial locking position.

* * * * *